United States Patent [19]

Holden

[11] Patent Number: 4,927,034

[45] Date of Patent: May 22, 1990

[54] STEERABLE POWER DRIVE FOR GANTRY CRANE

[76] Inventor: John A. Holden, 107 Shedoke Ave., Hamilton, Ontario, Canada, L8P 4P2

[21] Appl. No.: 220,330

[22] Filed: Jul. 18, 1988

[51] Int. Cl.[5] ..... B66C 5/02

[52] U.S. Cl. ..... 212/218; 104/126; 180/6.5; 212/205

[58] Field of Search ..... 212/208, 218, 219, 244, 212/254; 180/6.5, 6.48; 104/126

[56] References Cited

U.S. PATENT DOCUMENTS

| | | | |
|---|---|---|---|
| 2,865,034 | 12/1958 | Petite . | |
| 3,059,782 | 10/1962 | Baudhuin . | |
| 3,081,883 | 3/1963 | Minty | 180/6.48 |
| 3,329,284 | 7/1967 | Bogart, Jr. et al. . | |
| 3,381,833 | 5/1968 | Gordon . | |
| 3,698,581 | 10/1972 | Goyarts . | |
| 3,759,409 | 9/1973 | Wenzel et al. . | |
| 3,825,087 | 7/1974 | Wilson | 180/6.48 |
| 3,930,548 | 1/1976 | Wallraff | 180/6.5 |
| 3,936,707 | 2/1976 | Yoshida et al. | 318/139 |
| 4,078,630 | 3/1978 | Krieg | 180/6.5 |
| 4,280,578 | 7/1981 | Perkins | 180/6.5 |
| 4,286,915 | 9/1981 | La Berdia . | |
| 4,344,498 | 8/1982 | Lindfors | 180/6.5 |
| 4,475,611 | 10/1984 | Fisher | 180/6.5 |
| 4,599,030 | 7/1986 | Skaalen et al. . | |

FOREIGN PATENT DOCUMENTS

| | | | |
|---|---|---|---|
| 926822 | 5/1973 | Canada . | |
| 228242 | 3/1969 | U.S.S.R. | 212/218 |

OTHER PUBLICATIONS

"Power Drives for Motorized Gantry Application", brochure by Spanco, Inc.

"Do You Really Need a Costly Bridge Crane?", Advertisement by Spanco, Inc.

*Primary Examiner*—Sherman D. Basinger
*Assistant Examiner*—Thomas J. Brahan
*Attorney, Agent, or Firm*—Sughrue, Mion, Zinn, Macpeak & Seas

[57] ABSTRACT

There is described a new and improved self-propelled steerable gantry crane including an elevated load carrying beam, individually adjustable downwardly divergent pairs of legs spaced apart lengthwise of the beam proximal the ends thereof for supporting the beam, a tie rod between the lower ends of the legs to maintain and adjust the angularity between the legs and ground engaging mobile mountings for the gantry. The ground engaging mountings include a castering wheel disposed adjacent the lower end of one of each pair of the downwardly divergent legs to swivel about an upright axis perpendicular to the longitudinal axis of the tie rod, a fixed orientation wheel disposed adjacent the lower end of the other of each pair of legs to be aligned with the longitudinal axis of the tie rod, a motor operatively connected to each of the fixed orientation wheels to independently rotate the wheels in a forward or reverse direction and control means to independently actuate the motor for forward or reverse rotation of the fixed orientation wheel.

2 Claims, 3 Drawing Sheets

STEERABLE POWER DRIVE FOR GANTRY CRANE

FIELD OF THE INVENTION

The present invention relates to a load handling gantry having a beam supported at its ends typically by pairs of pivotally connected downwardly divergent legs, and more particularly to a means for providing such gantries with a steerable power drive mechanism.

BACKGROUND OF THE INVENTION

Load handling portable gantry cranes are well known in industry for the lifting and movement of heavy loads from one location to another within a shop or other industrial facility. A typical gantry of this sort is described in Canadian Pat. No. 926,822. To move such gantries from one place to another, or to turn the gantry, swivel casters are provided adjacent the bottom of each supporting leg, and the gantries are either manually pushed or pulled about, or are moved with the aid of a tractor. Such gantries may also be mounted on rails for simple back-and-forth movement, again usually by hand, but also by means of a power driven wheel.

The manual movement of gantries can be difficult particularly when heavy loads are involved, and although this can be alleviated to a certain extent by the use of rails, freedom of movement is then lost. There can also be an element of danger from swinging loads or when trying to control the gantries when being moved.

SUMMARY OF THE INVENTION

According to one object of the present invention, it is sought to mitigate the disadvantages of prior gantries by providing means by which the gantries can become self-propelled, which means further permit the gantries to be steered within a confined space.

According to the present invention, there is provided a self-propelled severable gantry comprising an elevated load carrying beam, individually adjustable downwardly divergent pairs of legs spaced apart lengthwise of the beam proximal the ends thereof for supporting the beam, tie means between the lower ends of the legs to maintain and adjust the angularity between the legs, and ground engaging mobile mountings for the gantry including: a castering wheel disposed adjacent the lower end of one of each pair of downwardly divergent legs to swivel about an upright axis perpendicular to the longitudinal axis of the tie means, a fixed orientation wheel disposed adjacent the lower ends of the other of the pairs of legs to be aligned with the longitudinal axis of the tie means, a prime mover operatively connected to each of the fixed orientation wheels to independently rotate the wheels in a forward or reverse direction, and control means operable to independently actuate the prime mover means for forward or reverse rotation of the fixed orientation wheels.

BRIEF DESCRIPTION OF THE DRAWINGS

Preferred embodiments of the present invention will now be described in greater detail and will be better understood when read in conjunction with the following drawings, in which.

DETAILED DESCRIPTION OF THE PREFERRED EMBODIMENTS

Figure 2:
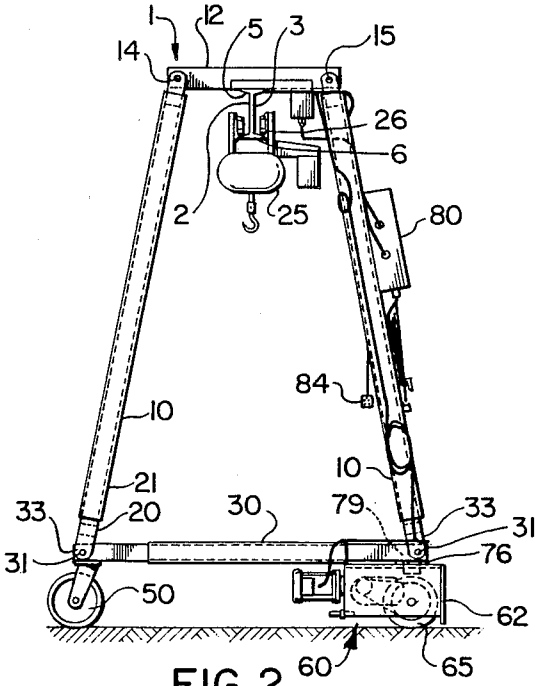
FIG. 2 is a side elevational view of the gantry crane of FIG. 1.
Figure 1:
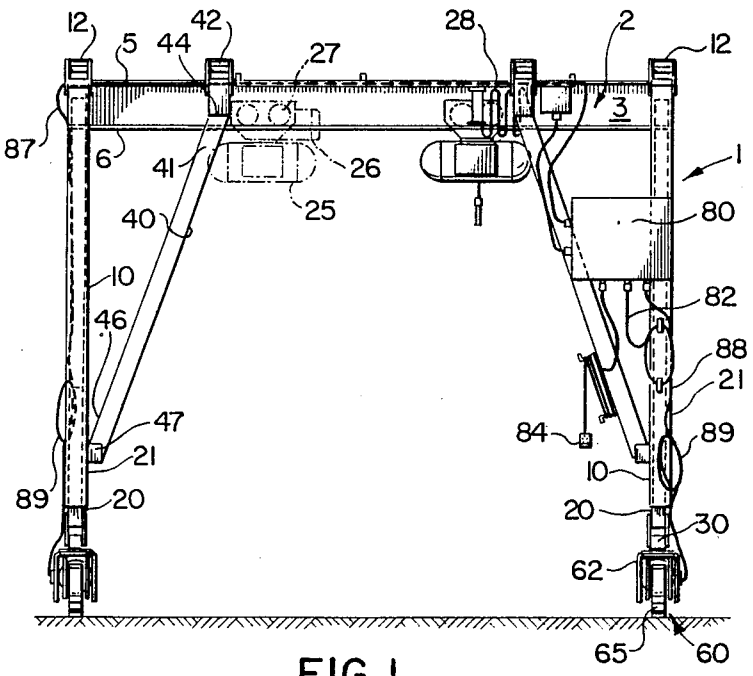
FIG. 1 is a front elevational view of a gantry crane including the drive mechanism of the present invention.

Load handling gantries are as aforesaid well known and will therefore be described only briefly with reference to FIGS. 1 and 2 illustrating a typical 5 ton portable gantry. It will be understood however that the gantry crane as shown is merely exemplary, and that the drive mechanism for gantries described herein is adaptable to gantries of different constructions.

With reference now to FIGS. 1 and 2, it will be seen that gantry 1 comprises a load-carrying member 2, such as an I-beam comprising a vertical web 3 and upper and lower longitudinally extending flanges 5 and 6. Beam 2 is supported adjacent its opposite ends by similarly structured pairs of downwardly divergent legs 10. The legs have their upper ends connected with the beam by means of a cross member 12 to which each of the upper ends is pivotally connected at pivot connections 14 and 15. The beam itself is suspended from cross member 12 by means of weldments, bolts or any other strong load bearing connection means. Each leg 10 comprises a telescopically associated inner and outer sleeve 20 and 21, respectively, so that the length of the legs can be independently adjusted by means of, for example, a pin (not shown) insertable through holes (also not shown) formed in the inner and outer sleeves.

The load may be suspended from beam 2 in any suitable manner, but is usually slung from an electric power hoist 25 suspended from a trolley 26 whose wheels 27 ride on the lower flange 6 of beam 2 for travel therealong. Other accoutrements are typically associated with the hoist and trolley as will be appreciated by those skilled in the art, including a spring-loaded takeup 28 for the power supply cord, but as these features are well known, and have relatively little to do with the present invention, further description thereof will be deleted.

Particularly under load conditions, the lower ends of legs 10 will tend to spread unless restrained and it is therefore the usual practise to incorporate tie means 30 between the lower ends of each pair of legs 10. The tie means may be for example a flexible piece of chain or rope, but more typically, greater stability and strength is to be obtained by means of a rigid tie bar 30 with or without length adjustment means. If length adjustment means are incorporated, the tie bar will usually comprise inner and outer telescopically associated sleeves (not shown) selectively adjustable for length by means of a retractable pin which cooperates with holes formed in the sleeves in much the same manner as described above with respect to the adjustability of legs 10. To accommodate the relative angling between legs 10 and tie bar 30, the joints between them is by means of horizontal pivots 31 extending through brackets 33 provided at the end of each leg and the adjoining portion of tie bar 30 engaged thereby.

The combination of adjustable legs 10 and tie bar 30 permits a substantial range of independent and coordinated variation in the height and spread of the gantry which of course lends the versatility needed to accommodate different load sizes and weights, available clearances, and also the surface over which the gantry will travel.

In the gantry as shown in FIGS. 1 and 2, legs 10 are braced by means of struts 40 respectively disposed on opposite sides of beam 2. The upper ends 41 of each strut are mounted on a second cross member 42 by means of a pivot 44. The lower end 46 of each strut 40 is coupled to its adjacent leg 10 by a similar pivot 47 fixed on the leg as shown schematically in FIG. 1.

To provide the gantry as described above with mobility, it has been the practice hitherto to mount swivel casters 50 beneath opposite ends of each tie bar 30, and to push or pull the gantry either manually or with the aid of some sort of tractor. It is now proposed to replace one of the casters at the corresponding ends of each tie bar with a power drive assembly 60 as will be described hereinafter in greater detail.

Figure 3:
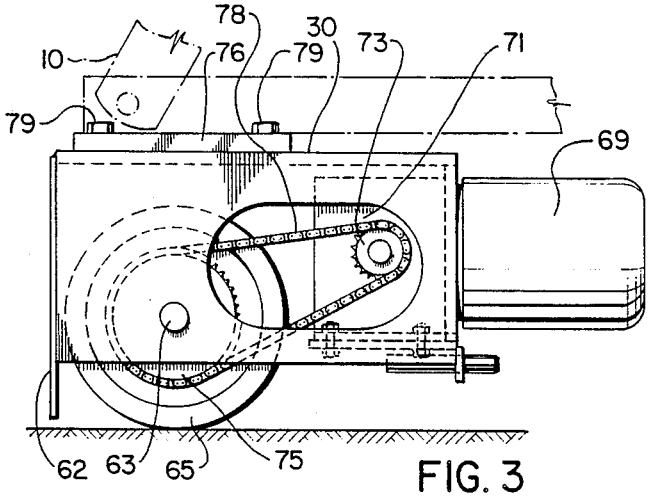
FIG. 3 is a side elevational view of a portion of the gantry showing the drive mechanism in greater detail.

With reference to FIG. 3, each assembly 60 consists of an outer (metallic) housing 62 which supports an axle 63 for a ground-engaging drive wheel 65 and a prime mover 69 such as a three-phase electric motor coupled to a gear box 71 with a drive sprocket 73 extending laterally therefrom. Drive wheels 65 include a relatively large laterally disposed drive sprocket 75 aligned with and connected to drive sprocket 73 by means of a drive chain 78 for rotation of the drive wheel in either the forward or reverse direction. A suitable motor/gear box combination found to provide good results by the applicant is a Marathon* coupled to an OH10*MQ206 drive.

*Trade Mark

To connect housing 62 to the gantry adjacent the lower ends of one of each pair of legs 10, a metal flange 76 is welded or bolted to the underside of tie bar 30 adjacent the respective end thereof to flush fit against the upper surface of housing 62. The two surfaces are then fastened together such as by means of bolts 79 so that the housing can be removed if required for replacement or repair of the drive assembly. Each of drive wheels 65 rotates about a fixed axle and is not free to pivot so that when the drive assembly is installed, the wheel is aligned with tie bar 30 to be perpendicular to the longitudinal axis of the gantry.

Each drive wheel is independently actuatable for separate operation in either the forward or reverse direction and, of course, neutral. An electrical control box 80 is connected to the gantry between one of legs 10 and the adjacent strut 40 in any suitable manner. Power to the unit is input via power cord 82 and in an embodiment constructed by the applicant, three-phase 60 Hz AC current at either 440 or 575 volts is supplied to operate the unit. If required, the unit can be adapted to operate on a 115 or 220/1/60 power supply. Control of the drive units is preferably provided by means of a handheld five-button pendant control 84 held by the operator in both hands for thumb actuation of the forward and reverse buttons on each side as well as a stop button. The buttons in each side of the control may be colour-coded to match the colours of each of housings 62. In the wiring diagram of FIG. 5, left hand wheel-drive housing is coloured yellow, whereas the right hand housing is black, and on the pendant control, the respective control buttons will be coloured correspondingly to provide a visual correlation for the operator. To provide for some slack in the electrical cords 87 and 88 providing power to the respective drive assemblies to accommodate adjustments to the lengths of legs 10, a few extra loops 89 of cord are provided in each circuit to the drive assemblies.

Figure 5:
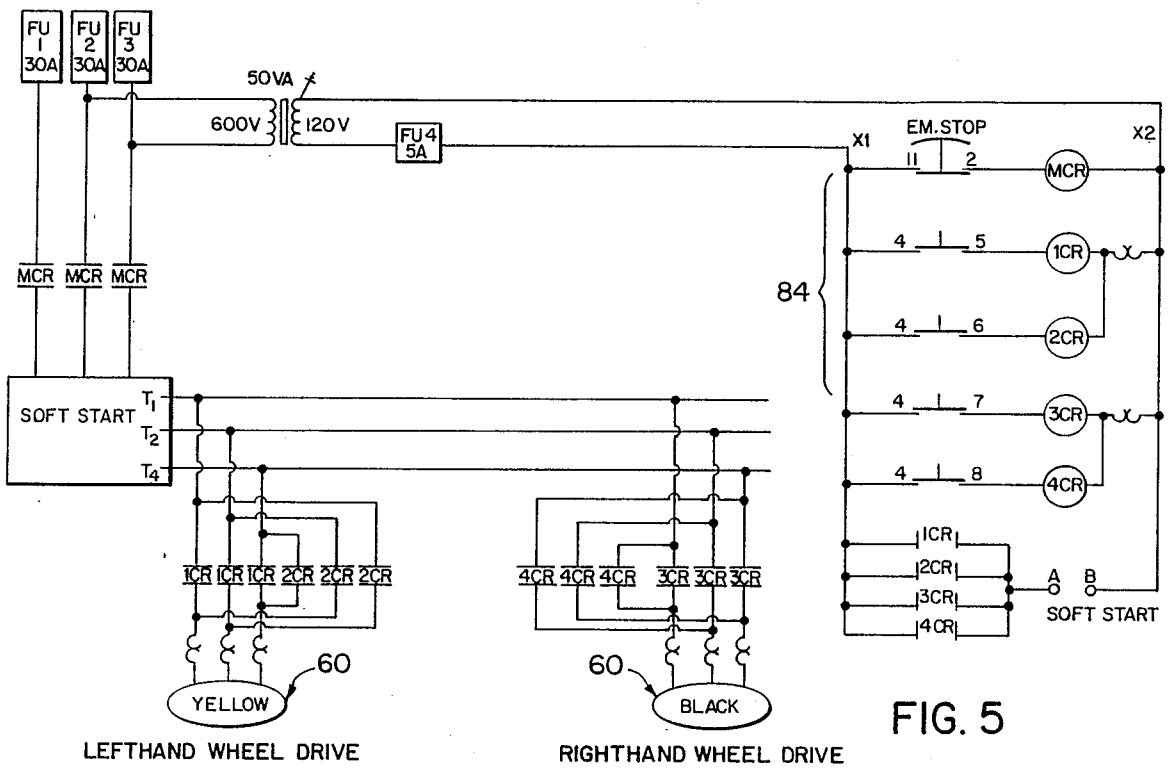
FIG. 5 is a wiring diagram for the gantry drive mechanism.

The electrical wiring and controls for the present gantry illustrated in the schematic of FIG. 5 will be self-evident to those skilled in the art and will not therefore be described in further detail herein, other than to indicate that the applicant has found it desirable to incorporate a micro-logic soft start into the circuitry to minimize load swinging at the commencement of travel.

Figure 4A:
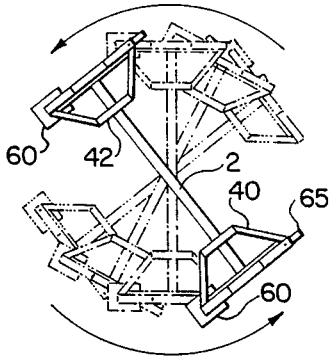
FIGS. 4*a* and 4*b* are schematical representations of the gantry in different turning modes.
Figure 4B:
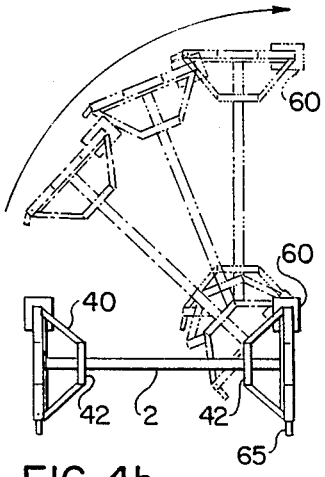

In operation, it will be evident from the foregoing description that in order to propel the gantry in a straight line in either the forward or reverse directions, the operator will actuate both drive assemblies in the same direction simultaneously. With reference to FIG. 4*a*, the gantry can be made to rotate about its vertical axis in a clockwise or counterclockwise direction by simultaneously actuating both drive assemblies in opposite directions. Broader radius turns may be accomplished as shown in FIG. 4*b* by allowing one drive to idle while actuating the opposite drive in the desired direction of the turn.

Drive wheels 65 may be standard semi-steel or urethane ground-engaging.

The principles, preferred embodiments and modes of operation and construction of the present invention have been described in the foregoing disclosure. The invention which is intended to be protected herein however is not to be construed as limited to the particular embodiments disclosed, since these embodiments are to be regarded as illustrative rather than restrictive. Variations and changes may be made by others without departing from the spirit and scope of the invention. Accordingly, it is expressly intended that all such variations and changes which fall within the spirit and scope of the invention be included within the scope of the following claim.

I claim:

1. A self-propelled steerable gantry comprising:

a. an elevated load carry beam;

b. individually adjustable downwardly divergent pairs of legs spaced apart lengthwise of said beam proximal the ends thereof for supporting said beam;

c. tie means between the lower ends of the legs of each said pair of legs to maintain and adjust the angularity between said legs; said tie means having a length which is substantially shorter than the length of said beam; and d. ground engaging mobile mountings for said gantry including:

i. a castering wheel disposed adjacent the lower end of one leg of each said pair of downwardly divergent legs, each said castering wheel being capable of swivelling about an upright axis perpendicular to the longitudinal axis of said tie means;

ii. a fixed orientation wheel disposed adjacent the lower end of the other leg of each said pair of legs and being aligned with the longitudinal axis of said tie means, the distance between the two fixed orientation wheels and the distance between the two castering wheels being substantially greater than the distance between the caster wheel and the fixed orientation wheel of each said pair of downwardly divergent legs in all adjustement positions of said legs;

iii. a prime power mover operatively connected to each of said fixed orientation wheels and capable of independently rotating each said fixed orientation wheel in a forward or reverse direction; and iv. control means operable to independently actuate said prime mover means for forward or reverse rotation of said fixed orientation wheels.

2. A self-propelled gantry as claimed in claim 1, wherein said control means further comprises circuitry to perform a soft start of said prime mover at the commencement of travel.

* * * * *